US009174887B1

(12) United States Patent
Maslo et al.

(10) Patent No.: US 9,174,887 B1
(45) Date of Patent: Nov. 3, 2015

(54) METHOD FOR THE PREPARATION OF HEAVY ANFO USING HIGH DENSITY AMMONIUM NITRATE AND GASSED BULK EMULSION

(71) Applicant: EXSA S.A., Lima (PE)

(72) Inventors: Karl Maslo, Lima (PE); Heberth Ruiz, Lima (PE)

(73) Assignee: EXSA S.A., Lima (PE)

( * ) Notice: Subject to any disclaimer, the term of this patent is extended or adjusted under 35 U.S.C. 154(b) by 0 days.

(21) Appl. No.: 14/447,917

(22) Filed: Jul. 31, 2014

(51) Int. Cl.

| | |
|---|---|
| ***C06B 31/00*** | (2006.01) |
| ***C06B 31/28*** | (2006.01) |
| ***D03D 23/00*** | (2006.01) |
| ***D03D 43/00*** | (2006.01) |
| ***C06B 21/00*** | (2006.01) |

(52) U.S. Cl.
CPC ..... *C06B 21/0008* (2013.01); *C06B 31/285* (2013.01)

(58) Field of Classification Search
USPC ..... 149/46, 45, 109.2, 109.4, 109.6
See application file for complete search history.

(56) References Cited

U.S. PATENT DOCUMENTS

| | | | | |
|---|---|---|---|---|
| 5,041,177 | A * | 8/1991 | Hajto | C06B 31/285 149/109.6 |
| 5,458,707 | A * | 10/1995 | Delagey | C06B 47/145 149/2 |
| 2006/0243362 | A1* | 11/2006 | Houston | C06B 23/001 149/46 |
| 2011/0132505 | A1* | 6/2011 | Dlugogorski | C06B 47/145 149/109.4 |

* cited by examiner

*Primary Examiner* — James McDonough
(74) *Attorney, Agent, or Firm* — Jones Day

(57) ABSTRACT

A method of preparing heavy ANFO including loading high density ammonium nitrate into a hopper; feeding the high density ammonium nitrate into a mixing chamber; during the feeding step, injecting fuel into a high density ammonium nitrate feeding pipe, thereby obtaining ANFO; loading bulk emulsion into a hopper; gassing the bulk emulsion; feeding the gassed bulk emulsion into a same mixing chamber as the ANFO; and mixing the gassed bulk emulsion and the ANFO, thereby obtaining heavy ANFO.

13 Claims, 1 Drawing Sheet

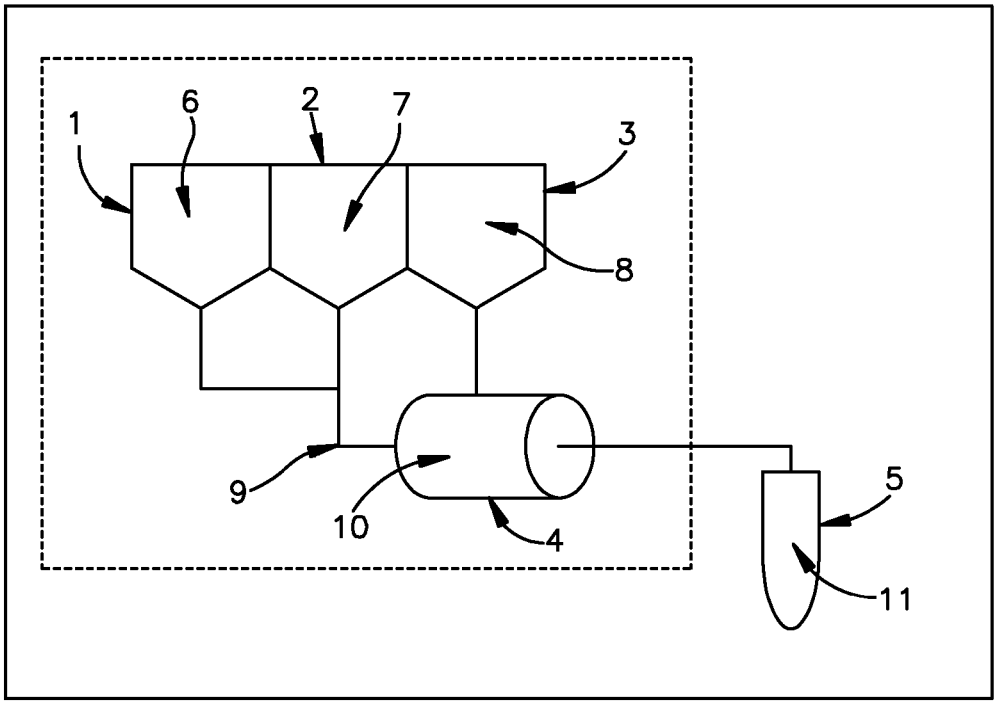
1
6
2
7
3
8
9
10
4
5
11

METHOD FOR THE PREPARATION OF HEAVY ANFO USING HIGH DENSITY AMMONIUM NITRATE AND GASSED BULK EMULSION

BACKGROUND OF THE INVENTION

1. Field of the Invention

The embodiments of the present invention are related to explosive compositions comprising a mixture of gassed bulk emulsion and ammonium nitrate/fuel oil (ANFO), also known as heavy ANFO, and in particular to a method for preparing the same by using high density ammonium nitrate in the manufacture of ANFO.

2. Description of the Related Art

Ammonium nitrate/fuel oil (ANFO) type explosives are a mixture of ammonium nitrate and fuel oil, which are used as a blasting compound in mining and industrial engineering. Typically, ANFO type explosives are composed of 94% ammonium nitrate and 6% fuel oil, and have a density of 0.8-0.9 kg/L. The ammonium nitrate particles used for ANFO type explosives are porous and spherical in shape because their microporous structure of air cavities enclosed within the body of the prills provide a larger number of points of initiation with increased detonation sensitivity, or hotspots, which are closed adiabatically as a result of mechanical action and spread the burning process throughout the charge. The fuel oil is absorbed by the ammonium nitrate particles to produce a free-flowing particulate mixture which can be detonated. Other additives may be added to this mixture in order to modify the properties of the ANFO explosive, such as adding guar gums and polyisobutylene to improve water resistance.

Detonation velocity of ANFO explosives falls within the range 2500-3500 m/s because of its volumetric density and flame temperature, which are lower than that of other industrial explosives. The sensitivity of these materials to detonation is also lower than that of emulsion and dynamite type explosives; thus, the handling of ANFO type explosives is easier. The performance of ANFO depends on the ammonium nitrate prills used and the efficiency of mixing the prills with the fuel oil.

Heavy ANFO type explosives comprise a mixture of bulk emulsion and ammonium nitrate/fuel oil (ANFO). The use of emulsion type explosives as a coating substance creates a waterproof-resistant barrier, surrounding the particles of ANFO and solving the problem of its low water resistance. This waterproof-resistant barrier also improves other characteristics of ANFO by increasing its density, detonation velocity, sensitivity to initiation and shock wave intensity. Heavy ANFO is typically prepared in a bulk truck by making ANFO first, and then blending it with emulsion. Bulk emulsion used in the preparation of heavy ANFO may be gassed or not gassed. The system of heavy ANFO allows for a great deal of flexibility in the relative proportions of ANFO/bulk emulsion. This ratio can be optimized depending on the blast site-specific requirements.

As mentioned, ANFO and heavy ANFO type explosives typically need porous ammonium nitrate prills. However, the present invention provides a method to prepare heavy ANFO by using high density ammonium nitrate, preferably fertilizer or technical grade (see Table 1), as a substitute for porous ammonium nitrate in the ANFO manufacturing process. The method includes using gassed bulk emulsion and ANFO to manufacture heavy ANFO. The explosive composition of ANFO is modified to use less fuel than regular ANFO type explosives.

Information about the Assignee

EXSA was incorporated in 1954. The company's plant, offices and main warehouses are located in Lima, Peru. In addition, the company has various business offices, other industrial plants, powder magazines, and warehouses throughout the Peruvian territory.

EXSA engages in the manufacture, transformation, industrial operation, representation, development, research, marketing, distribution, transportation, import and export of explosives, as well as their components, accessories, associated products and by-products. Likewise, EXSA may provide any services associated with the aforementioned activities, including specialized support works for mining prospecting, development and operation, and ore reduction.

SUMMARY OF THE INVENTION

An object of the present invention includes a method of preparing heavy ANFO including loading high density ammonium nitrate into a hopper; feeding the high density ammonium nitrate into a mixing chamber; during the feeding step, injecting fuel into a high density ammonium nitrate feeding pipe, thereby obtaining ANFO; loading bulk emulsion into a hopper; gassing the bulk emulsion; feeding the gassed bulk emulsion into a same mixing chamber as the ANFO; and mixing the gassed bulk emulsion and the ANFO, thereby obtaining heavy ANFO.

Another object of the present invention includes a method of preparing heavy ANFO including loading high density ammonium nitrate with a density of at least 0.95 kg/L into a hopper; feeding the high density ammonium nitrate into a mixing chamber; during the feeding step, injecting fuel into a high density ammonium nitrate feeding pipe at a ratio of at least 2 parts fuel to 98 parts high density ammonium nitrate, thereby obtaining ANFO; loading bulk emulsion into a hopper; gassing the bulk emulsion; feeding the gassed bulk emulsion into a same mixing chamber as the ANFO at a ratio of at least 20 parts gassed bulk emulsion to 80 parts ANFO; and mixing the gassed bulk emulsion and the ANFO, thereby obtaining heavy ANFO.

Yet another object of the present invention includes a method of preparing heavy ANFO including loading high density ammonium nitrate, with a density of 0.95 to 1.00 kg/L, an oil absorbency of less than or equal to 4%, and a crushing strength of 0.4-0.6 kg, into a hopper; feeding the high density ammonium nitrate into a mixing chamber; during the feeding step, injecting fuel such as a biofuel, biodiesel, diesel, mineral oil and residual oil into a high density ammonium nitrate feeding pipe at a mixing ratio range of 2:98 to 6:94, thereby obtaining ANFO; loading bulk emulsion into a hopper; gassing the bulk emulsion; feeding the gassed bulk emulsion into a same mixing chamber as the ANFO; and mixing the gassed bulk emulsion and the ANFO at a mixing ratio range of 20:80 to 70:30, thereby obtaining heavy ANFO.

BRIEF DESCRIPTION OF THE DRAWINGS

FIG. 1 shows the process and components related thereto used to manufacture heavy ANFO.

DETAILED DESCRIPTION OF THE INVENTION

The embodiments of the present invention provide a method to prepare heavy ANFO by using high density ammonium nitrate, preferably fertilizer or technical grade, as a substitute for porous ammonium nitrate in the ANFO manufacturing process. The method includes using gassed bulk emulsion and ANFO to manufacture heavy ANFO. The explosive composition of ANFO is modified to use less fuel than regular ANFO type explosives.

Heavy ANFO production is performed as illustrated in FIG. 1. This process is preferably performed in a factory truck located at the different mining units. The process includes the step of feeding high density ammonium nitrate 7 to a hopper 2. High density ammonium nitrate used in this preparation has the preferred characteristics described below in Table 1.

TABLE 1

Typical Characteristics of High Density Ammonium Nitrate for Preparation of ANFO and Heavy ANFO

| | | High Density Ammonium Nitrate | |
|---|---|---|---|
| Parameter | Unit | Technical Grade | Fertilizer Grade |
| Bulk density | kg/L | 0.95-1.00 | |
| Oil absorbency | % | <4 | |
| Crushing strength | kg | 0.4-0.6 | |
| $NH_4NO_3$ Purity | % | >98.5 | >97.5 |
| Insoluble | % | 0 | <2 |
| Calcium (CaO) | % | 0 | <2 |
| Magnesium (MgO) | % | 0 | <2 |
| Phosphorus ($P_2O_5$) | % | 0 | <3.5 |
| Potassium ($K_2O$) | % | 0 | <2 |

The fuel 6 in the hopper 1 is injected into the high density ammonium nitrate feeding pipe, obtaining ANFO 9. The ratio of this mixture ranges from 98:2 to 94:6, and is preferably 97:3. The fuel 6 used for the manufacture of ANFO may include biofuel, biodiesel, diesel, mineral oil and residual oil.

The bulk emulsion 8 in the hopper 3 must be gassed. In this process, chemical gassing agents react chemically within the oxidizer salt phase under proper pH conditions in order to produce a fine dispersion of nitrogen gas bubbles throughout the emulsion. Typical gassing agents include a wide variety of gas generating materials known in the art. Preferably, the gassing agent is a nitrite, and more preferably an alkali metal nitrite, and most preferably sodium nitrate. Chemical gassing in these compositions is achieved by reacting the nitrite with an ammonium ion in order to produce nitrogen gas. The gassing agent can be mixed with a second chemical which is used as a catalyst in order to improve the rate at which the reaction proceed, such as sodium thiocyanate or thio urea, among others. Chemical gassing by nitrite gassing agents may be accelerated, for example, by lowering the pH of the gassing solution. Preferably, the pH is lowered to between 1 and 5, and more preferably between 2 and 4. Suitable acids include sulphuric acid, nitric acid, acetic acid, and others known in the art.

Then, the gassed bulk emulsion 8 is mixed with ANFO 10, obtaining heavy ANFO 11. Preferred mixing ratios of gassed bulk emulsion 8 and ANFO 10 include: 20:80, 30:70, 40:60, 50:50, 60:40 and 70:30. The final product 11 is used to fill the boreholes 5 in mining operations.

We claim:

1. A method of preparing heavy ANFO comprising:

loading high density ammonium nitrate into a hopper;

feeding the high density ammonium nitrate into a mixing chamber, during the feeding step, injecting fuel into a high density ammonium nitrate feeding pipe, thereby obtaining ANFO;

loading bulk emulsion into a hopper;

gassing the bulk emulsion;

feeding the gassed bulk emulsion into a same mixing chamber as the ANFO;

mixing the gassed bulk emulsion and the ANFO, thereby obtaining heavy ANFO; and wherein the high density ammonium nitrate includes a bulk density in the range of 0.95-1.00 kg/L, an oil absorbency of less than or equal to 4%, and a crushing strength of 0.4-0.6 kg.

2. The method according to claim 1, wherein the fuel includes biofuel, biodiesel, diesel, mineral oil and residual oil.

3. The method according to claim 1, wherein a fuel to high density ammonium nitrate mixing ratio includes 2:98 to 6:94.

4. The method according to claim 1, wherein a gassed bulk emulsion to ANFO mixing ratio includes 20:80 to 70:30.

5. A method of preparing heavy ANFO comprising:

loading high density ammonium nitrate into a hopper, wherein the high density ammonium nitrate has a density of at least 0.95 kg/L;

feeding the high density ammonium nitrate into a mixing chamber while injecting fuel into a high density ammonium nitrate feeding pipe, wherein the mixing ratio of the fuel with respect to the high density ammonium nitrate is at least 2:98, thereby obtaining ANFO;

loading bulk emulsion into a hopper;

gassing the bulk emulsion;

feeding the gassed bulk emulsion into the same mixing chamber as the ANFO, wherein the mixing ratio of the gassed bulk emulsion with respect to the ANFO is at least 20:80;

mixing the gassed bulk emulsion and the ANFO in the mixing chamber, thereby obtaining heavy ANFO; and wherein high density ammonium nitrate includes a density having a range of about 0.95 to 1.00 kg/L, an oil absorbency of less than or equal to 4%, and a crushing strength of 0.4-0.6 kg.

6. The method according to claim 5, wherein the fuel includes biofuel, biodiesel, diesel, mineral oil and residual oil.

7. The method according to claim 5, wherein a fuel to high density ammonium nitrate mixing ratio includes 2:98 to 6:94.

8. The method according to claim 5, wherein a gassed bulk emulsion to ANFO mixing ratio includes 20:80 to 70:30.

9. A method of preparing heavy ANFO comprising:

loading high density ammonium nitrate into a hopper, wherein the high density ammonium nitrate has a density with a range from 0.95 to 1.00 kg/L, an oil absorbency of less than or equal to 4%, and a crushing strength of 0.4-0.6 kg;

feeding the high density ammonium nitrate into a mixing chamber while injecting fuel into a high density ammonium nitrate feeding pipe, wherein the fuel includes a biofuel, biodiesel, diesel, mineral oil and residual oil, wherein a mixing ratio of the fuel with respect to the high density ammonium nitrate includes 2:98 to 6:94, thereby obtaining ANFO;

loading bulk emulsion into a hopper;

gassing the bulk emulsion;

feeding the gassed bulk emulsion into a same mixing chamber as the ANFO, wherein the mixing ratio of the gassed bulk emulsion with respect to the ANFO includes 20:80 to 70:30; and mixing the gassed bulk emulsion and the ANFO in the mixing chamber, thereby obtaining heavy ANFO.

10. The method according to claim 1, wherein the gassing step includes using a first gassing agent, the first gassing agent including a nitrate, an alkali metal nitrate, and a sodium nitrate.

11. The method according to claim 10, wherein the gassing step includes using a second gassing agent as a catalyst with the first gassing agent, the second gassing agent chemical including a sodium thiocyanate and a thio urea.

12. The method according to claim 1, wherein the gassing step further includes lowering the pH of a gassing solution to between 1 and 5 using suitable acids including sulphuric acid, nitric acid, and acetic acid.

13. The method according to claim 12, wherein the gassing step further includes lowering the pH of the gassing solution to between 2 and 4.

* * * * *